US005457858A

United States Patent [19]

Lin

[11] Patent Number: 5,457,858

[45] Date of Patent: Oct. 17, 1995

[54] CLIP

[76] Inventor: Mao-Chuan Lin, 28 Yung-Hsin 1st St. Gin-Nan Li, Tainan, Taiwan

[21] Appl. No.: 336,161

[22] Filed: Nov. 7, 1994

[51] Int. Cl.[6] ..... A44B 21/00

[52] U.S. Cl. ..... 24/511; 24/501

[58] Field of Search ..... 24/511, 500, 501, 24/504, 491, 492, 493, 494, 557, 565

[56] References Cited

U.S. PATENT DOCUMENTS 4,660,750 4/1987 Blanchard ..... 24/501

5,052,086 10/1991 Nasuno ..... 24/511

5,402,558 4/1995 Santapa ..... 24/511

*Primary Examiner*—Victor N. Sakran

[57] ABSTRACT

A clip comprising two half bodies of a symmetrical structure, and two inverted U-shaped clasps combined together, each half bodies having two clasp openings spaced apart in an upper lengthwise edge for the two clasps to fit and catch hold of a vertical sloped wall in each clasp opening, the two half bodies being able to be pressed inward at their heads to open a normally closed lower sides and then to be closed by elasticity of the two clasps when the heads are released.

1 Claim, 4 Drawing Sheets

CLIP

BACKGROUND OF THE INVENTION

This invention concerns a clip, particularly one using no springs for closing or opening.

A known conventional clip shown in FIG. 1 comprises two— an upper and a lower—half bodies 1 and 2, a recovery spring 7 and a shaft 8 combined together.

The upper half body 1 has two projecting ears 3, 4 spaced apart in an intermediate portion, and the lower half body 2 has two projecting ears 5, 6 spaced apart . Then the two half bodies 1 and 2 are placed together side by side, and the recovery spring 7 is deposited between the two ears 3, 4 and 5, 6, and then a shaft 8 is inserted through holes of the four ears 3, 4, 5, 6 and through the recovery spring 7. This conventional clip has too many components, and too complicated structure to assemble.

SUMMARY OF THE INVENTION

The object of this invention is to offer a kind of clip having simple structure and a few components to assemble together.

A clip in the present invention comprises two—a left and a right—half bodies combined together by means of two clasps. The two half bodies have a symmetrical structure of two clasp openings for fitting therein the two clasps catching hold of the two half bodies to open the normally closed lower end of the two half bodies by manually pressing together the heads of the two half bodies. And the two clasps have enough elasticity to be expanded to let the clip open and close.

DETAILED DESCRIPTION OF THE INVENTION

Figure 3:
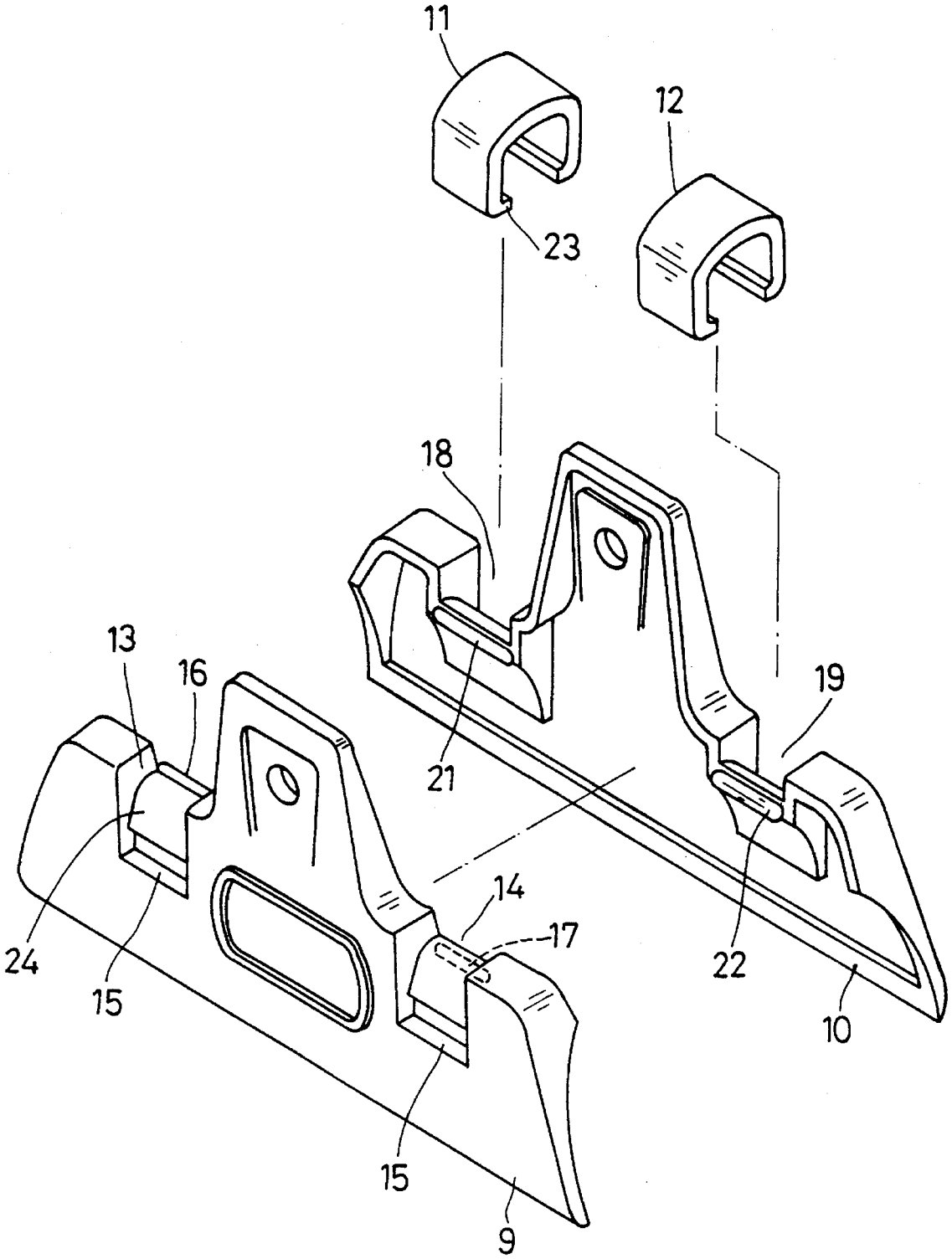
FIG. 3 is an exploded perspective view of the clip in the present invention.
Figure 4:
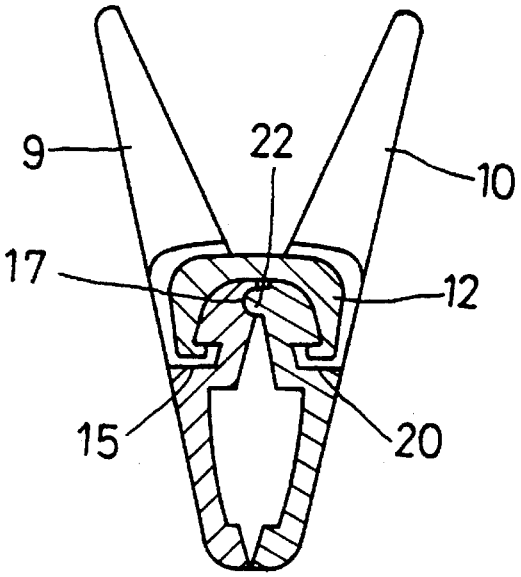
FIG. 4 is a cross-sectional view of line I—I of FIG. 2.

A clip in the present invention as shown in FIG. 3 and 4 comprises a left half body 9, a right half body 10, a front inverted U-shaped clasp 11, and a rear inverted, U-shaped clasp 12 combined together.

The left half body 9 has a clasp opening 13, 14 respectively in the front portion and in the rear portion a groove 15 respectively provided in the outer side of the bottom of the two clasp opening 13, 14, a lengthwise round edge 16 provided in the upper portion of the front clasp opening 13, a lengthwise curved ridge 17 provided in the upper portion of the rear clasp opening 14. The right half body 10 has two clasp openings 18, and 19 corresponding to the two clasp openings 13 and 14 of the left half body 9, a groove 20 respectively provided in the outer side of the bottom of each of two clasp openings 18 and 19 a lengthwise curved groove 21 in the inner side of the bottom of the front clasp opening 18 to correspond to the lengthwise round ridge 16 of the clasp opening 13 of the left half body 9 a lengthwise round ridge 22 in the inner side of the bottom of the clasp opening 19 to correspond to the lengthwise curved groove 17 of the clasp opening 14 of the left half body 9.

The clasps 11, and 12 are shaped as an inverted U, respectively having an projecting-inward ridge 23 respectively along the two bottom edges defining a lower opening.

Figure 1:
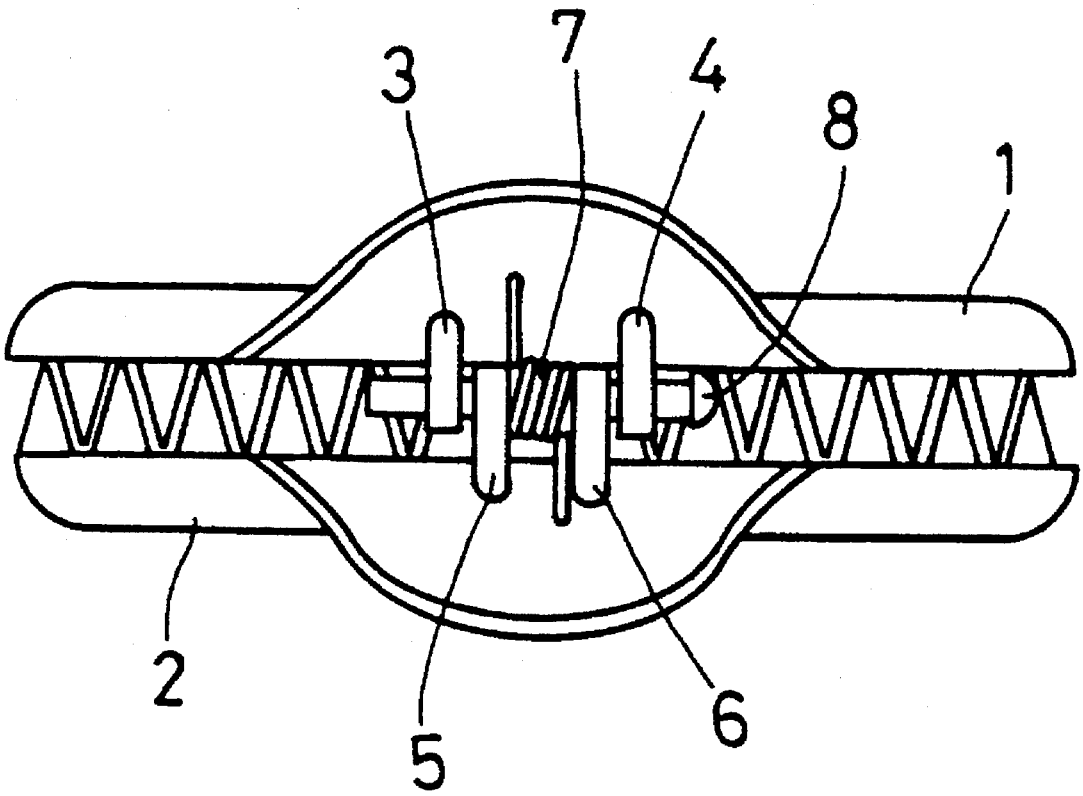
FIG. 1 (PRIOR ART)
FIG. 1 is a front view of a known conventional clip.
Figure 2:
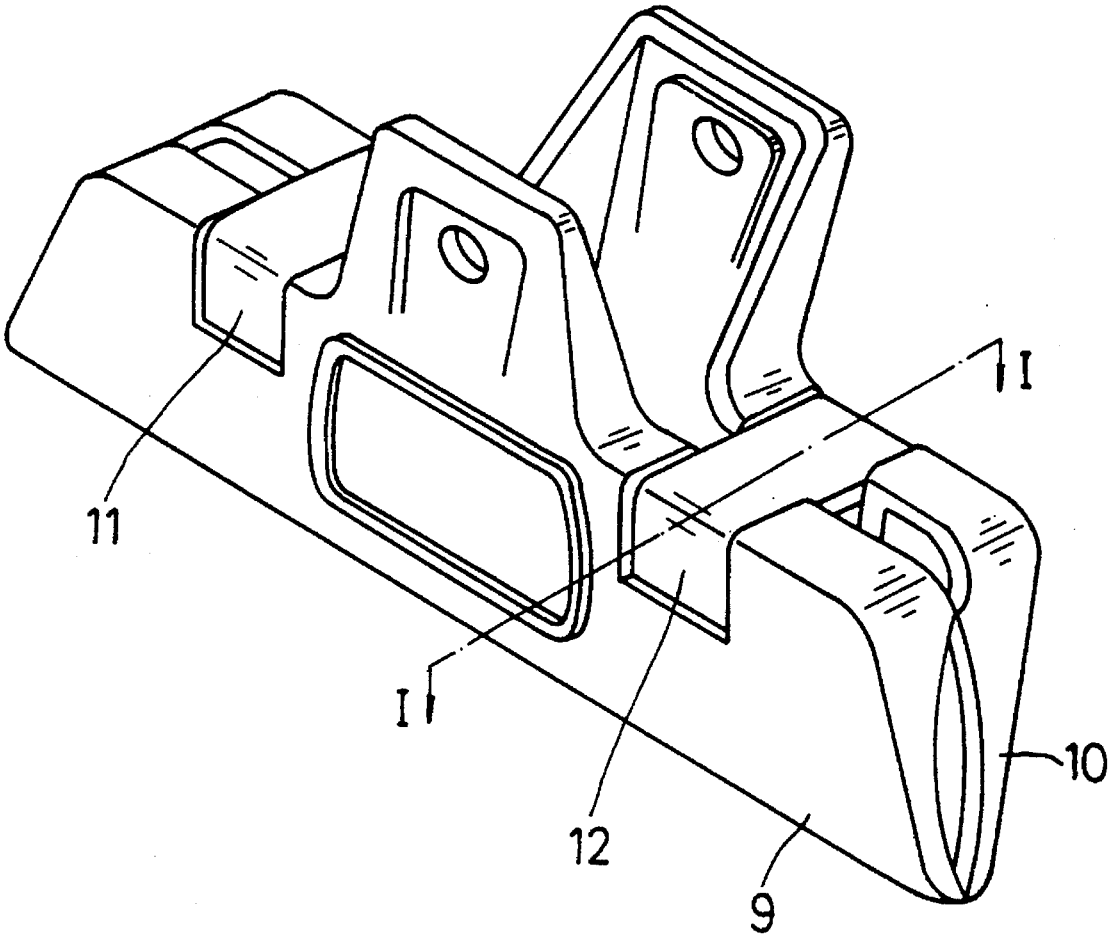
FIG. 2 is a perspective view of a clip in the present invention.

In combining, the two half bodies 9 and 10 are closely put together side by side, with the round edge 16 fitting in the curved groove 21, and with the round ridge 22 fitting in the curved groove 17. Then two clasps 11, 12 are placed in the two pairs of clasp openings 13 and 18; 14 and 19, and pushed manually down along a sloped-down surface 24 respectively provided from both sides of the round ridge 16 and the curved groove 17 to the two grooves 15, 15, forcing the projecting-inward ridges 23 of the two clasps 11 and 12 to engage the grooves 15 and 20 finishing assemblage of this clip, as shown in FIG. 2.

Figure 5:
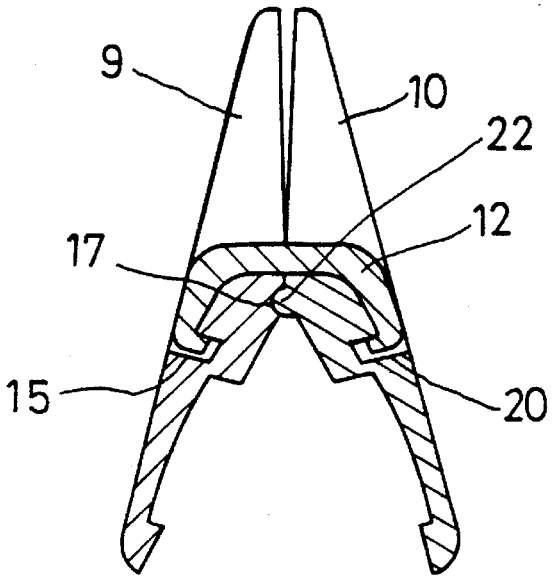
FIG. 5 is a cross-sectional view of the clip in the present invention, showing it opened for pinching something.

In using, referring to FIG. 5, the heads of the two half bodies 9 and 10 are manually pressed inward, forcing the lower ends of the two half bodies 9 and 10 to open outward, with the round ridges 22 and 16 and the curved grooves 21 and 17 to move outward with the axis as a pivot. After the heads of the two bodies 9 and 10 are released, the elasticity of the two clasps 11 and 12 forces the lower ends of the bodies 9 and 10 close together.

It is evident from the above description that the clip in the present invention has advantageous effects as follows.

1. Easy assemblage and a few components and a resultant lower cost.
2. Lower cost than conventional clips because of comparatively few components, satisfying economical effectiveness.
3. Low replacement percentage because of plastic material without welding or engagement of any metal.

What is claimed is:

1. A clip comprising:

a left half body having a front clasp opening and a rear clasp opening in the upper lengthwise edge separated by a projecting head in the intermediate portion, said front clasp opening having a lengthwise groove at the outer side of its bottom, a lengthwise round ridge at the upper portion, said rear clasp opening having a lengthwise groove at its bottom, a lengthwise curved groove at the upper portion, and two sloped-down surfaces from each of both sides of said lengthwise groove and said lengthwise ridge to said two bottom grooves;

a right half body having a front and a rear clasp opening to correspond to the two clasp openings of said left half body, said front clasp opening of said right half body having a groove at the outer side of its bottom, said rear clasp opening of said right half body having a lengthwise round ridge at the upper portion to engage said lengthwise curved groove of said rear clasp opening of said left half body;

two inverted U-shaped clasps respectively having a lower opening, a lengthwise projecting-inward ridge respectively provided at each of both sides of the lower opening; and said two half bodies being placed together side by side, letting the round ridge of said front clasp opening of said left half body engaging the curved groove of said front clasp opening of said right half body letting the round ridge of said right clasp opening of said right half body engage the curved groove of said right clasp opening of said left half body then said two inverted U-shaped clasps being placed in said two clasp openings to tough the upper portion of each opening and then pushed down to move down along said two side sloped-down surfaces, forcing said projecting-inward ridges engage said bottom grooves to finish assemblage of said clip.

* * * * *